US011535960B2

(12) United States Patent
Wu

(10) Patent No.: US 11,535,960 B2
(45) Date of Patent: Dec. 27, 2022

(54) TEXTILE FOR SHOE UPPER AND SHOE BODY INCLUDING THE SAME

(71) Applicant: JHIH HUEI TRADING CO., LTD., Changhua County (TW)

(72) Inventor: Yung-Yu Wu, Changhua County (TW)

(73) Assignee: JHIH HUEI TRADING CO., LTD., Fuxing Township (TW)

( * ) Notice: Subject to any disclaimer, the term of this patent is extended or adjusted under 35 U.S.C. 154(b) by 327 days.

(21) Appl. No.: 16/852,024

(22) Filed: Apr. 17, 2020

(65) Prior Publication Data

US 2021/0321720 A1 Oct. 21, 2021

(51) Int. Cl.

| | |
|---|---|
| ***A43B 1/04*** | (2022.01) |
| ***D04B 21/06*** | (2006.01) |
| ***D04B 21/10*** | (2006.01) |
| ***A43B 23/02*** | (2006.01) |
| ***D03D 13/00*** | (2006.01) |
| ***D03D 1/00*** | (2006.01) |

(52) U.S. Cl.

CPC ..... *D03D 13/002* (2013.01); *A43B 1/04* (2013.01); *D03D 1/00* (2013.01); *D03D 13/004* (2013.01); *D04B 21/06* (2013.01); *D04B 21/10* (2013.01); *A43B 23/0245* (2013.01); *D10B 2501/043* (2013.01)

(58) Field of Classification Search

None

See application file for complete search history.

(56) References Cited

U.S. PATENT DOCUMENTS

| | | | | | |
|---|---|---|---|---|---|
| 2,412,808 | A * | 12/1946 | Goldstein | A43B 1/04 | 36/11.5 |
| 3,738,125 | A * | 6/1973 | Blezard | D04B 39/00 | 66/170 |
| 4,003,224 | A * | 1/1977 | Odham | D04B 21/18 | 66/193 |
| 4,122,555 | A * | 10/1978 | Safrit | D04B 1/243 | 2/407 |
| 4,248,064 | A * | 2/1981 | Odham | D04B 21/18 | 66/190 |

(Continued)

FOREIGN PATENT DOCUMENTS

| | | | | |
|---|---|---|---|---|
| DE | 3017951 A1 * | 11/1981 | ..... | D04B 21/18 |
| DE | 3035232 A1 * | 4/1982 | ..... | D04B 21/12 |

(Continued)

*Primary Examiner* — Khoa D Huynh

*Assistant Examiner* — Grace Huang

(74) *Attorney, Agent, or Firm* — Muncy, Geissler, Olds & Lowe, P.C.

(57) ABSTRACT

A woven textile for shoe upper includes a main body. The main body includes a woven portion and at least one braiding portion. The main body defines a horizontal direction and a longitudinal direction. The woven portion includes a plurality of longitudinal threads aligned along the horizontal direction. Each of the longitudinal threads extends along the longitudinal direction. Two ends of the woven portion along the longitudinal direction are a first end and a second end. At least one of the longitudinal threads extends and is knotted itself from the first end or the second end of the woven portion away from the woven portion to form the at least one braiding portion.

6 Claims, 2 Drawing Sheets

(56) References Cited

U.S. PATENT DOCUMENTS 4,725,487 A * 2/1988 Pemrick ..... D04B 21/165 442/148
4,748,078 A * 5/1988 Doi ..... D04B 21/08 66/169 A
5,038,584 A * 8/1991 Wildeman ..... D04B 21/165 66/192
5,074,129 A * 12/1991 Matthew ..... D04B 21/12 66/192
5,265,445 A * 11/1993 Shyties ..... D04B 21/18 602/76
5,795,835 A * 8/1998 Bruner ..... D04B 21/16 442/310
6,041,624 A * 3/2000 Pederzini ..... D04B 21/18 66/193
6,196,031 B1 * 3/2001 Ducauchuis ..... D04B 21/02 24/445
6,374,643 B2 * 4/2002 Orima ..... D04B 21/202 66/193
7,011,676 B2 * 3/2006 Dong ..... A61F 2/86 623/1.15
7,055,572 B2 * 6/2006 Nien ..... E06B 9/386 160/178.3
7,168,951 B2 * 1/2007 Fischer ..... A61C 9/0033 433/136
8,915,101 B2 * 12/2014 Koizumi ..... D04B 27/14 66/193
9,174,395 B2 * 11/2015 Durie ..... D04B 21/14
9,510,637 B2 * 12/2016 Podhajny ..... A43B 23/04
9,554,614 B2 * 1/2017 Follet ..... A43C 1/04
10,385,485 B2 * 8/2019 Cross ..... A43B 23/0265
10,660,408 B2 * 5/2020 Houng ..... A43C 1/003
11,230,800 B2 * 1/2022 Cross ..... A43B 23/04
11,259,599 B2 * 3/2022 Bruce ..... A43C 1/06
2001/0005994 A1 * 7/2001 Motoya ..... D04B 21/12 66/194
2016/0073592 A1 * 3/2016 Toye ..... A01G 13/0206 47/31
2016/0096127 A1 * 4/2016 McClary ..... B01D 69/10 210/490
2017/0203880 A1 * 7/2017 Giro Amigo ..... B65D 29/00
2018/0295942 A1 * 10/2018 Drake ..... A43B 11/00
2019/0203388 A1 * 7/2019 Liu ..... D03D 15/587
2020/0385902 A1 * 12/2020 Karatzis ..... D04B 21/10
2021/0010169 A1 * 1/2021 Wu ..... D03D 15/497
2021/0017678 A1 * 1/2021 Wu ..... D03D 13/006
2021/0180227 A1 * 6/2021 Wu ..... D04B 21/12
2021/0235807 A1 * 8/2021 Casillas ..... D04C 1/06
2021/0277548 A1 * 9/2021 Wu ..... D04B 1/102
2021/0372013 A1 * 12/2021 Wu ..... D04B 21/20
2022/0152976 A1 * 5/2022 Wu ..... B32B 5/26

FOREIGN PATENT DOCUMENTS

FR 2205072 A6 * 5/1974 ..... D04B 21/10
GB 295547 A * 8/1928 ..... D04B 21/18
GB 1139371 A * 1/1969 ..... D04B 21/12
GB 2319045 A * 5/1998 ..... D04B 21/20

* cited by examiner

TEXTILE FOR SHOE UPPER AND SHOE BODY INCLUDING THE SAME

BACKGROUND OF THE INVENTION

Field of the Invention

The present invention relates to a textile, more especially to a textile for shoe upper.

Description of the Prior Art

Shoes having woven upper are popular nowadays due to the excellent flexibility and air permeability.

For example, the shoe body disclosed in patent TW 1646911 is composed of a sole and a shoe upper. The shoe upper is made of a textile and is connected to the periphery of the sole.

However, all the filaments of the shoe upper have to be fixed to the sole so that the periphery of the sole becomes bumpy, and that the flexibility of the shoe upper is reduced.

SUMMARY OF THE INVENTION

The main object of the present invention is to provide a textile for shoe upper and a shoe body. The textile for shoe upper can be used on different portions of the shoe upper by different ways of connection.

To achieve the above and other objects, the textile for shoe upper of the present invention includes a main body. The main body includes a warp knitted portion and at least one string portion. The main body defines a horizontal direction and a longitudinal direction perpendicular to each other. The warp knitted portion at least includes a plurality of longitudinal threads. Two ends of the warp knitted portion along the longitudinal direction are a first end and a second end. At least one of the longitudinal threads extends and is knotted itself from at least one of the first end and the second end of the warp knitted portion away from the warp knitted portion to form the at least one string portion.

To achieve the above and other objects, the shoe body of the present invention includes a sole and at least one shoe upper. The at least one shoe upper includes at least one said textile for shoe upper mentioned above. The main body is connected to the sole via the string portions so that a wearing space is formed between the main body and the sole.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figures 1, 1A, 1B:
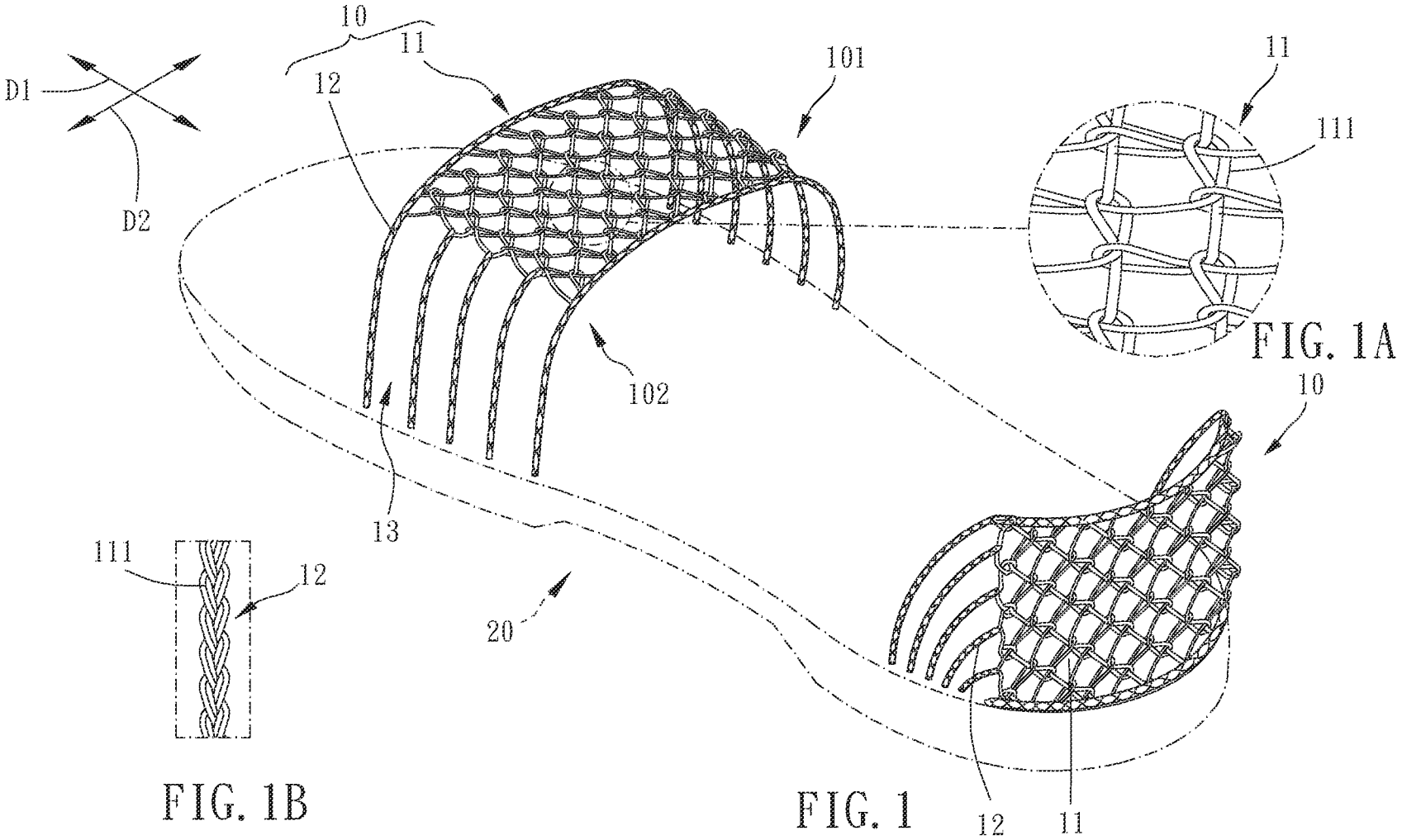
FIG. 1 is a stereogram of the present invention.
FIG. 1A is a partial stereogram showing a warp knitted portion of the present invention.
FIG. 1B is a partial stereogram showing a string portion of the present invention.

Please refer to FIG. 1, FIG. 1A, FIG. 1B, and FIG. 2, the textile for shoe upper of the present invention includes a main body 10. The main body 10 includes a warp knitted portion 11 and a plurality of string portions 12. The main body 10 defines a horizontal direction D1 and a longitudinal direction D2 perpendicular to each other.

The warp knitted portion 11 at least includes a plurality of longitudinal threads 111. Each of the longitudinal threads 111 may be a single filament, or each of the longitudinal threads 111 may be composed of a plurality of filaments which are braided together or not. Two ends of the warp knitted portion 11 along the longitudinal direction D2 are a first end 101 and a second end 102. Each of the longitudinal threads 111 extends from the first end 101 or the second end 102 of the warp knitted portion 11 away from the warp knitted portion 11 to form one of the string portions 12. The plurality of string portions 12 are separately arranged in intervals in the horizontal direction D1, and there are voids 13 located between the plurality of string portions 12. An end of each of the string portions 12 away from the warp knitted portion 11 is adapted for connecting to a sole 20. In other embodiments, the end of each of the string portions 12 away from the warp knitted portion 11 can be adapted for connecting to another textile for shoe upper or other portions on the shoe upper.

Figure 2:
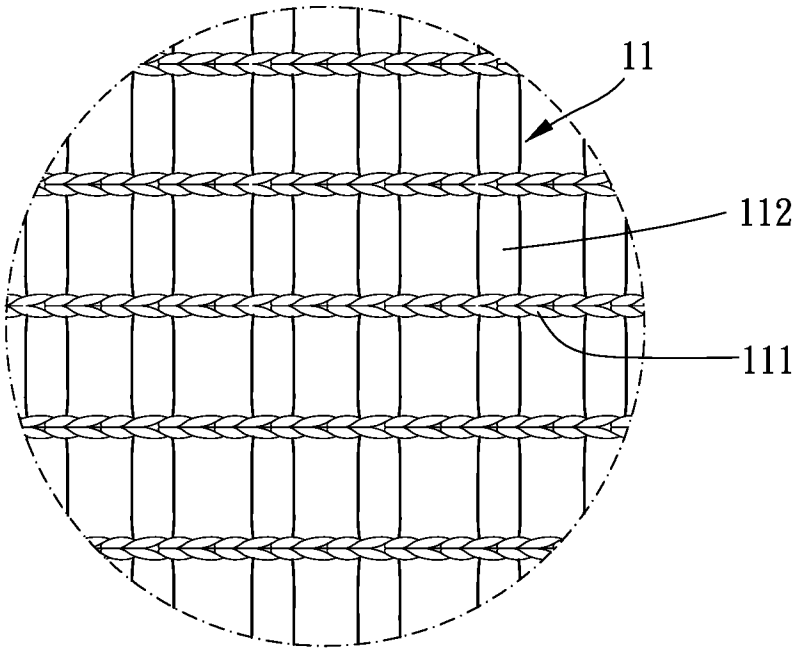
FIG. 2 is a partial stereogram showing a warp knitted portion of a second embodiment of the present invention.

In the present embodiment, the warp knitted portion 11 is woven by the longitudinal threads. More specifically, the adjacent longitudinal threads 111 are intertwined to form the warp knitted portion 11. In other possible embodiments, as shown in FIG. 2, the warp knitted portion 11 can be woven by the longitudinal threads 111 and a plurality of horizontal threads 112. Thus, the weaving way and the pattern of the warp knitted portion 11 is not restricted.

Besides, in the present embodiment, each of two ends of each of the longitudinal threads 111 forms one of the string portions 12. That is, the number of the string portions 12 is twice the number of the longitudinal threads 111. In other embodiment, each of the string portions 12 can be braided by two or three adjacent longitudinal threads 111.

The present invention further provides a shoe body including a sole 20 and at least one shoe upper. The at least one shoe upper includes at least one said textile for shoe upper mentioned above. The main body 10 is connected to the sole 20 via the string portions 12 so that a wearing space is formed between the main body 10 and the sole 20.

The main body 10 can be connected to various positions of the sole 20. For example, in the present embodiment, a third end of the warp knitted portion 11 of a back portion of the main body 10 along the horizontal direction (the lateral side) is connected to a periphery of a heel portion of the sole 20, and the end of each of the string portions 12 away from the warp knitted portion 11 of the back portion of the main body 10 is connected to a periphery of the sole 20 beside the heel portion. Thus, the main body 10 forms a heel covering portion. However, the ends of the string portions 12 of a front portion of the main body 10 at the first end 101 and the second end 102 away from the warp knitted portion 11 of the front portion of the main body 10 are connected to a periphery of the sole 20 at two sides of the sole 20, and the warp knitted portion 11 of the front portion of the main body 10 is located above the sole 20 and is separated from the sole 20. Besides, the main body can be connected to other positions, such as the toe portion.

Practically, the main body can be used at different positions or on different sizes of shoes by cutting the string portions for appropriate lengths. In addition, the shoe upper is fixed only by connecting the string portions to the sole. The design of the warp knitted portion and the string portions can be alternated too.

What is claimed is:

1. A textile for a shoe upper, including a main body, the main body including a warp knitted portion and a plurality of string portions, the main body defining a horizontal direction and a longitudinal direction perpendicular to each other, the warp knitted portion at least including a plurality of longitudinal threads, the warp knitted portion along the longitudinal direction comprising a first end and a second end, the plurality of the longitudinal threads integrally and continuously extending respectively from one of the first end and the second end of the warp knitted portion away from the warp knitted portion to form the plurality of string portions, wherein the plurality of longitudinal threads continuously extend in the longitudinal direction, respectively;

wherein each of the plurality of string portions is composed of at least one of the longitudinal threads;

wherein the plurality of string portions are separately arranged in intervals in the horizontal direction, and there are voids located between the plurality of string portions.

2. The textile for the shoe upper of claim 1, wherein each of the longitudinal threads extends from one of the first end and the second end away from the warp knitted portion to form one of the string portions, an end of each of the string portions away from the warp knitted portion is adapted for connecting to a sole, wherein the first end and the second end are on opposing sides of the warp knitted portion.

3. The textile for the shoe upper of claim 2, wherein each of the longitudinal threads is composed of a plurality of filaments.

4. A shoe body, including a sole and at least one shoe upper, the at least one shoe upper including at least one textile, the at least one textile including a main body, the main body including a warp knitted portion comprising a front portion, the front portion comprising a first plurality of string portions, the main body defining a horizontal direction and a longitudinal direction perpendicular to each other, the warp knitted portion at least including a first plurality of longitudinal threads in the front portion, the warp knitted portion along the longitudinal direction comprising a first end and a second end of the front portion of the warp knitted portion, the first plurality of the longitudinal threads of the front portion integrally and continuously extending respectively from one of the first end and the second end of the front portion of the warp knitted portion away from the front portion of the warp knitted portion to form the first plurality of string portions, wherein the first plurality of longitudinal threads continuously extend in the longitudinal direction, respectively;

wherein each of the plurality of string portions is composed of at least one longitudinal thread of the first plurality of longitudinal threads;

wherein the first plurality of string portions are separately arranged in intervals in the horizontal direction, and there are voids located between the first plurality of string portions, wherein each of the first plurality of longitudinal threads of the front portion extends from one of the first end and the second end away from the front portion of the warp knitted portion to form one of the first plurality of string portions, an end of each of the first plurality of string portions away from the warp knitted portion is connected to the sole, wherein the first end and the second end are on opposing sides of the front portion of the warp knitted portion, the main body being connected to the sole and continuously extending from a first side of the sole to a second side of the sole via the first plurality of string portions so that a wearing space is formed between the main body and the sole.

5. The shoe body of claim 4, wherein the main body including the warp knitted portion further comprises a back portion, the back portion comprising a second plurality of string portions, the warp knitted portion further comprising a second plurality of longitudinal threads in the back portion, wherein the back portion of the warp knitted portion along the horizontal direction comprises a third end connected to a periphery of a heel portion of the sole, the second plurality of the longitudinal threads of the back portion integrally and continuously extending from the third end of the back portion away from the back portion of the warp knitted portion to form the second plurality of string portions, wherein each of the second plurality of string portions is composed of at least one of the longitudinal threads of the second plurality of longitudinal threads, wherein the second plurality of string portions are separately arranged in intervals in the horizontal direction, and there are voids located between the second plurality of string portions, the end of each of the second plurality of string portions away from the back portion of the warp knitted portion is connected to a periphery of the sole beside the heel portion.

6. The shoe body of claim 4, wherein the ends of the first plurality of string portions at the first end and the second end away from the front portion of the warp knitted portion are connected to a periphery of the sole at the first side and second side of the sole, the front portion of the warp knitted portion is located above the sole and is separated from the sole.

* * * * *